US007929875B2

(12) United States Patent
Nishida

(10) Patent No.: US 7,929,875 B2
(45) Date of Patent: Apr. 19, 2011

(54) IMAGE FORMING APPARATUS

(75) Inventor: Satoshi Nishida, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 423 days.

(21) Appl. No.: 12/061,108

(22) Filed: Apr. 2, 2008

(65) Prior Publication Data

US 2009/0003858 A1 Jan. 1, 2009

(30) Foreign Application Priority Data

Jun. 27, 2007 (JP) ..... 2007-168888

(51) Int. Cl.
*G03G 15/00* (2006.01)
*G03G 21/00* (2006.01)

(52) U.S. Cl. ..... 399/48; 399/346

(58) Field of Classification Search ..... None
See application file for complete search history.

(56) References Cited

U.S. PATENT DOCUMENTS

2005/0191099 A1* 9/2005 Yamaguchi et al. ..... 399/346
2006/0133872 A1* 6/2006 Sugiura et al. ..... 399/346
2007/0059067 A1* 3/2007 Tanaka et al. ..... 399/346
2009/0169236 A1* 7/2009 Fukao et al. ..... 399/99

FOREIGN PATENT DOCUMENTS

JP 2002-244486 A 8/2002

* cited by examiner

*Primary Examiner* — David P Porta
*Assistant Examiner* — Carolyn Igyarto
(74) *Attorney, Agent, or Firm* — Cantor Colburn LLP

(57) ABSTRACT

An image forming apparatus, including: a photoconductor; a charging section to apply an electrical potential onto a surface of the photoconductor; a cleaning device to remove toner particles remaining on the surface of the photoconductor; a coating section to coat the surface of the photoconductor with a lubricant; an electrical potential detecting section to detect the electrical potential of the surface of the photoconductor; and a control section which controls a coating condition of the lubricant based on a value of the electrical potential of the surface of the photoconductor, detected by the electrical potential detecting section.

8 Claims, 3 Drawing Sheets

IMAGE FORMING APPARATUS

CROSS REFERENCE TO RELATED APPLICATION

This application is based on Japanese Patent Application No. 2007-168888 filed on Jun. 27, 2007 with the Japanese Patent Office, the entire content of which is hereby incorporated by reference.

FIELD OF THE INVENTION

The present invention relates to an image forming apparatus, such as a copy machine, a printer and a facsimile device, each of which employs an electro-photographic method, and in particular, to an image forming apparatus incorporating a coating means to apply a lubricant onto the surface of a photoconductor to maintain a preferable lubricated condition.

BACKGROUND OF THE INVENTION

In recent years, the users have required image forming apparatuses, employing the electro-photographic method, which form color images, exhibiting high quality images, comparative to offset prints.

To form multi-color image by the electro-photographic method, various types of methods can be listed, one of which superimposes each color toner image on an intermediate transfer body.

In a case that an intermediate transfer body is used, mostly used is a method in which when the toner image is to be transferred onto the intermediate transfer body from the photoconductor, a first transfer section is formed, wherein a transfer roller carrying an electrical voltage is controlled to press the back of the intermediate transfer body against the photoconductor.

However, during the above transfer operation, some portions of the toner image may still remain on the photoconductor, and are not transferred, whereby desired transfer operation is not conducted, which is a problematic matter for the image forming apparatus. Specifically, during the image transfer operation, toner particles, which form a line drawing or a central area of dotted images, receive high pressure by being nipped between the photoconductor and the intermediate transfer body, so that the toner particles tend to agglutinate, and the agglutinated toner particles are not transferred to the intermediate transfer body, but remain on the photoconductor. Accordingly the middle portion of the image remain blank, which phenomenon is usually regarded as "the hollow defect".

Said hollow defect occurs due to the magnitude relationship between the adhering force between the toner particles and the photoconductor, and the adhering force between the toner and the intermediate transfer body. If the adhering force between the toner particles and the photoconductor is reduced, the probability of occurring of said hollow defect can be minimized.

An effective method to reduce the adhering force between the toner particles and the photoconductor is one in which a lubricant is applied onto the surface of the photoconductor. A metal stearate, such as zinc stearate or the like, is generally used as the lubricant. As the method to apply the lubricant, a rotating brush scrapes off some solid lubricant, at a position distant from the position where the rotating brush later touches the photoconductor, and the solid lubricant carried by the rotating brush is applied onto the surface of the photoconductor (see FIG. 2). Further, if the friction factor between photoconductor 10 and blade 15 is relatively great, photoconductor 10 and blade 15 are deteriorated due to the friction. However, cleaning performance of cleaning device 14 can be increased due to the lubricant applied onto the surface of photoconductor 10.

Concerning the conventional arts, Unexamined Japanese Patent Application Publication No. 8-137,354 discloses that the lubricant is applied onto a cleaning brush through a flicker roller in a cleaning device, whereby in order to prevent a filming layer or fine powder among the toner particles, which generates black spots on images, from adhering onto the photoconductor, further, in order to prevent the toner particles adhered onto background areas from increasing, and still further, in order to obtain a high quality image exhibiting a high adhering amount of the image characters, fog density of the toner on the photoconductor is detected so that an applied amount of lubricant is appropriately controlled.

Further, Unexamined Japanese Patent Application Publication No. 2002-244,486 discloses a technology in which for an image forming apparatus, employing toner particles with a small diameter, or employing minute toner particles, solid lubricant is applied onto the surface of a photoconductor drum by a rotating brush, so that the surface of the photoconductor is coated with a thin coat of the lubricant, whereby the amount of lubricant to be applied onto the surface of the photoconductor is controlled based on information of outputting images which were previously stored.

In the normal state, since an appropriate amount of lubricant is applied onto the surface of the photoconductor at the cleaning device, the electrical potential is controlled within a certain range. However, if images carrying relatively high text ratio, are continuously printed, a large amount of toner is supplied to a brush, whereby the amount of toner accumulated on the brush tends to become greater than the amount of toner removed by the flicker. Due to this situation, the brush cannot remove the appropriate amount of the lubricant, so that the surface of the photoconductor cannot be coated with the appropriate amount of lubricant. Further, since the toner particles have been accumulated onto the brush, when the brush contacts the surface of the photoconductor, any portion on which the toner particles are directly adhered, becomes to exist on the photoconductor, and any portion which the brush directly contacts also becomes to exist on the photoconductor. If the brush directly applies frictional electrification onto the photoconductor, not through the lubricant, any one of the photoconductor or the brush is charged to be a negative electrode or a positive electrode, and vise versa, due to the frictional electrification, which depends on the constituent materials of the photoconductor and the brush. Still further, if the toner accumulated on the brush contacts the photoconductor due to the frictional electrification, the same phenomenon as above occurs. Due to the frictional electrification, the surface of the photoconductor is highly charged to become the negative electrode or positive electrode.

Under the above-described state, if the amount of lubricant applied onto the photoconductor is measured by the detection of the fog density of toner on the photoconductor, it is difficult to measure the amount of lubricant with high accuracy, because the measurement depends upon the using condition of the developer, the thickness of the surface of the photoconductor, and the ambient environment of the image forming apparatus. Further, if the amount of lubricant applied onto the photoconductor is measured based on image forming information such as the printing pattern, it is also difficult to measure the amount of lubricant with high accuracy, due to insufficient information.

SUMMARY OF THE INVENTION

The electrical potential of the surface of the photoconductor differs between a condition in which the sufficient amount of lubricant has been coated onto the surface of the photoconductor, and a condition in which an insufficient amount of lubricant has been coated. Accordingly, an object of the present invention is to provide an image forming apparatus exhibiting high reliability, in which a coated condition is detected by the detected electrical potential, whereby the coating amount can be appropriately controlled so that the coating amount of lubricant onto the photoconductor can be set to be a reasonable amount, and faulty image transfer due to faulty cleaning cannot occur.

The above object can be attained by items described below.

Item 1. An image forming apparatus, including:

a photoconductor, a charging section to apply an electrical potential onto a surface of the photoconductor, a cleaning device to remove toner particles remaining on the surface of the photoconductor, a coating section to coat the surface of the photoconductor with a lubricant, an electrical potential detecting section to detect the electrical potential of the surface of the photoconductor, and a control section which controls a coating condition of the lubricant based on a value of the detected electrical potential of the surface of the photoconductor.

Item 2. An image forming apparatus, including:

a photoconductor, a charging section to apply an electrical potential onto a surface of the photoconductor, a cleaning device to remove toner particles remaining on the surface of the photoconductor, a coating section to coat the surface of the photoconductor with a lubricant, an electrical potential detecting section to detect an electrical potential of the surface of the photoconductor, and a control section which controls to display a warning message to replenish the lubricant based on a value of the detected electrical potential of the surface of the photoconductor.

DETAILED DESCRIPTION OF THE INVENTION

Figure 1:
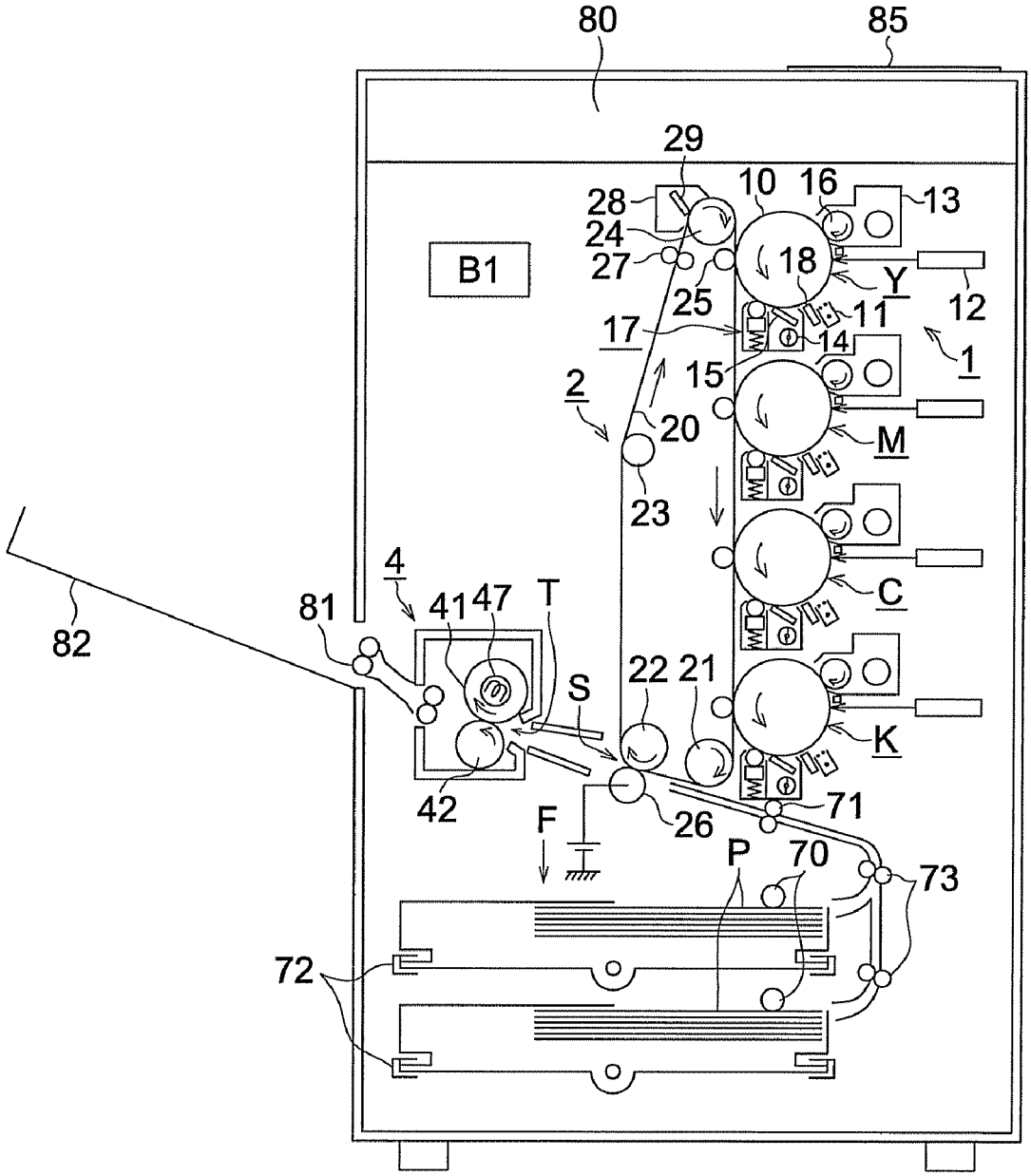
FIG. 1 is a schematic drawing to show an example of the total structure of the image forming apparatus.

Firstly, the image forming apparatus of the present invention will be detailed while referring to FIG. 1.

This basic explanation of the present invention is not meant to limit the technical scope by the given meaning of the terms used in this specification.

FIG. 1 is a schematic drawing to show an example of the total structure of this image forming apparatus.

In FIG. 1, numeral 10 represents a photoconductor serving as an image carrier, numeral 11 represents a scorotron charging device serving as a charging section, numeral 12 represents a writing device which is a digital exposure writing device, numeral 13 represents a developing device, numeral 14 represents a cleaning device to clean the surface of photoconductor 10, numeral 15 represents a blade to clean the surface of photoconductor 10, numeral 16 represents a developing sleeve, numeral 17 represents a coating device to coat the surface of photoconductor 10 with lubricant, numeral 18 represents a discharging lamp serving as an electrical charge discharging section, numeral 19 represents an electrical potential detecting section to detect the electrical potential on the surface of photoconductor 10, and numeral 20 represents an intermediate transfer belt serving as a intermediate transfer body. In addition, a cleaning device including a coating mechanism will be detailed later.

Image forming device 1 is formed of photoconductor 10, scorotron charging device, developing device 13, and an un-illustrated trestle to support cleaning device 14, whereby image forming device 1 can be inserted into or pulled out from the main body along un-illustrated guide rails. Since the same mechanical structure is used for the image forming devices of each color, the reference numerals are only applied to the elements of the yellow system in the figure, and the reference numerals are omitted for the elements of the magenta, cyan, and black systems.

Image forming devices 1 for each color are arranged in the order of Y, M, C and K in the running direction of intermediate transfer belt 20. when the transfer operation is conducted, primary transfer roller 25 presses intermediate transfer belt 20 against photoconductor 10. Further, in a pressing area of the transfer operation, photoconductor 10 rotates in the same running direction and at the same line speed as those of intermediate transfer belt 20.

Intermediate transfer belt 20 is entrained about drive roller 21, electrically grounding roller 22, tension roller 23, paired discharging rollers 27, and driven roller 24, whereby belt unit 2 is structured of the above rollers, intermediate transfer belt 20, primary transfer roller 25, and cleaning device 28 serving as the cleaning means. Further, belt unit 2 can be inserted into or pulled out from the main body along un-illustrated guide rails mounted on an un-illustrated trestle.

Each photoconductor 10 is formed in such a way that an electrically conductive layer, and a photosensitive layer such as an a-Si layer or an organic photoreceptor (OPC) are coated on the periphery of an aluminum cylinder base. Each photoconductor 10 rotates counterclockwise as shown by arrows in FIG. 1, and its electrically conductive layer is grounded.

Electrical signals for the image data, sent from reading device 80 or the digital data sent from a PC, are converted to optical signals by an image forming laser, and said optical signals are radiated onto photoconductor 10 by writing device 12.

Developing device 13 has cylindrical sleeve 16, formed of non-magnetic stainless steel or aluminum, which is separated from the surface of photoconductor 10 at a prescribed clearance, and rotates in the opposite direction of the rotating direction of photoconductor 10.

The traveling motion of intermediate transfer belt 20 is conducted by the rotation of drive roller 21 driven by an un-illustrated motor. Endless intermediate transfer belt 20, exhibiting $10^6$-$10^{12}$ volume resistivity, which is, for example, a double-layered seamless belt, including a 0.04-0.10 mm semi-conductive film base, having electrically conductive components which are dispersed on an engineering plastic, such as denaturated polyimide, hot cured polyimide, ethylenetetrafluoroethylene copolymer, poly-vinylidene fluoride, and a nylon composition, and also including a 5-50 μm fluorine-coat as a toner filming preventing layer, coated on said semiconductor film base. A 0.5-2.0 mm semi-conductive rubber layer can also be used for the base of the belt, wherein the electrical conductive components are dispersed on a silicon rubber, or an urethane rubber.

Direct current exhibiting the polarity opposite to that of the toner is applied onto primary transfer roller 25, which presses intermediate transfer belt 20 against photoconductor 10 from the inner surface of the belt, whereby the toner image formed on photoconductor 10 is transferred onto intermediate transfer belt 20.

Numeral 26 represents a secondary transfer roller, which presses against grounded roller 22 through both intermediate transfer belt 20 and transfer member P, by a press-and-release mechanism which is not illustrated, whereby the toner image on intermediate transfer belt 20 is transferred onto transfer member P at nip area S formed by grounded roller 22 and secondary transfer roller 26. In addition, secondary transfer roller 26 is formed of an electro-conductive solid rubber, whose surface is covered with a coating layer on which the bias voltage exhibiting the polarity opposite to that of the toner is applied during the transfer operation, (otherwise, it is also possible to apply the voltage exhibiting the same polarity as the toner onto grounded roller 22, while secondary transfer roller 26 is grounded).

Alternating-current voltage added to the direct-current voltage, exhibiting the same polarity as or the opposite polarity to the toner, is applied onto discharging roller 27. After the toner image is transferred onto transfer member P, discharging roller 27 discharges the electrical charge remaining within intermediate transfer belt 20.

Numeral 4 is a fixing device serving as the fixing section, which includes heating roller 41 and pressure applying roller 42.

Cylindrical heating roller 41, formed of thick aluminum, includes halogen heater 47 to heat to a predetermined temperature. The temperature of heating roller 41 is detected by a contact-type temperature sensor, mounted on heating roller 41, which is not illustrated, and is controlled.

Numerals 70 represent sheet feeding rollers, numeral 71 represents paired timing rollers, and numerals 72 represent sheet supply trays, removable from the apparatus through slide mechanisms. Numerals 73 represent paired sheet conveyance rollers. Numeral 81 represents paired sheet ejection rollers, which eject transfer member P onto tray 82 after the fixing operation.

Control section B1 conducts various controls, such as the image forming process control, the fixing temperature control, the transfer member conveyance control, the toner density control, and the cleaning brush rotation-speed control which is related to the present invention.

Next, the image forming process will be detailed while referring to FIG. 1.

Simultaneously with the start of image recording, a photoconductor drive motor, which is not illustrated, rotates photoconductor 10 for yellow signal Y counterclockwise as shown by a curved arrow, and scorotron charging device 11, via its charging function, simultaneously starts to apply electrical potential to photoconductor 10.

After the electrical charge has been applied onto photoconductor 10, writing device 12 starts to write an image corresponding to the Y image data, whereby an electrostatic latent image corresponding to a Y image data representing the original document is formed on the surface of photoconductor 10.

Said electrostatic latent image is developed into a reversal image by developing device 13 under the non-contact condition, and a Y toner image is formed on photoconductor 10 due to the rotation of photoconductor 10.

Said Y toner image formed on photoconductor 10 is primarily transferred onto intermediate transfer belt 20 by the function of primary transfer roller 25 for Y.

After that, coating device 17 coats the surface of photoconductor 10 with a lubricant, and cleaning blade 15 removes the remaining toner, to prepare for the next image forming cycle (and since the cleaning processes of M, C and K are the same as that of Y, the redundant explanations are omitted).

Next, writing device 12 writes an image corresponding to M (magenta) color signals, that is, M image data, whereby an electrostatic latent image corresponding to the M image of the original document is formed on the surface of photoconductor 10. Said electrostatic latent image is formed to become the M toner portion of the full color image on photoconductor 10 by developing device 13 for M, said M toner image is then synchronized to the Y toner image which was previously formed on intermediate transfer belt 20, so that the M toner image is superposed on the Y toner image by primary transfer roller 25 for M.

By the same processes as the above, a C (cyan) toner image is synchronized onto the superposed Y and M images, and is superposed on the superposed Y and M images by primary transfer roller 25 for C. Subsequently, a K (black) toner image is synchronized onto the superposed Y, M and C images, and is further superposed on the superposed Y, M and C images by primary transfer roller 25 for K, that is, a full color toner image of Y, M, C and K is formed.

Intermediate transfer belt 20, carrying said superposed Y, M, C and K toner images, is rotated clockwise as shown by the arrows. Transfer member P is fed by sheet feeding roller 70 from one of sheet supply trays 72, and is conveyed to paired timing rollers 71, through paired sets of conveyance roller 73, where transfer member P is temporarily stopped. Subsequently, by the rotation start of paired timing rollers 71, transfer member P is synchronized with the superposed images, carried on intermediate transfer belt 20. After that, transfer member P is conveyed to nipping area S, which is formed by the pressure contact of intermediate transfer belt 20 and secondary transfer roller 26, wherein secondary transfer roller 26 carries the direct current voltage, which is the reverse of that of the toner. Then, the superposed images on intermediate transfer belt 20 are collectively and secondarily transferred onto transfer member P.

Subsequently, intermediate transfer belt 20 is rotated, and the electrical charge of the remaining toner is decreased by grounded discharging roller 27, further, the remaining toner on intermediate transfer belt 20 is removed by blade 29 of cleaning device 28, to prepare for the next image forming cycle.

The removed toner is temporarily stored within cleaning device 28, after which the stored toner is conveyed by the rotation of a conveyance screw, which is not illustrated, in a screw shaft direction (which is from the front surface to the reverse surface of FIG. 1), to a toner storing box through a disposal tube (neither of which are illustrated).

Transfer member P carrying said superposed images is conveyed to fixing device 4, wherein transfer member P is nipped at nipping area T formed by heating roller 41 and pressure applying roller 42, so that the superposed images carried on transfer member P are permanently fixed, which is then conveyed onto sheet ejection tray 82.

The coating operation of lubricant, and the electrical potential of the photoconductor, both relating to the present invention, will now be detailed.

As described above, if images with relatively high amount of text ratio are continuously printed, a large amount of toner is supplied to the brush so that the surface of the photoconductor cannot be coated with the appropriate amount of lubricant. Further, since the toner particles have been accumulated on the brush, when the brush contacts the surface of the photoconductor, a portion of the photoconductor, on which the toner particles have been directly adhered, becomes to exist, and a portion of the photoconductor which the brush directly contacts also becomes to exist. If the brush directly contacts the photoconductor by the frictional electrification not through the lubricant, either the photoconductor or the brush is charged either negatively or positively by the frictional electrification. Still further, if the toner particles accumulated on the brush contact the photoconductor by the frictional electrification, the same phenomenon as above occurs. Due to these frictional electrifications, the surface of the photoconductor is highly charged to be a negative electrode or a positive electrode. These phenomena adversely affect image formation of the subsequent toner image downstream of cleaning device 14, and the primary transfer operation onto intermediate transfer belt 20 is adversely affected.

In the present invention, based on a surface electrical potential between the brush and the surface of the photoconductor, the amount of lubricant to be coated onto the surface of the photoconductor is controlled within a predetermined amount, so that stable image formation can be maintained.

Figure 2:
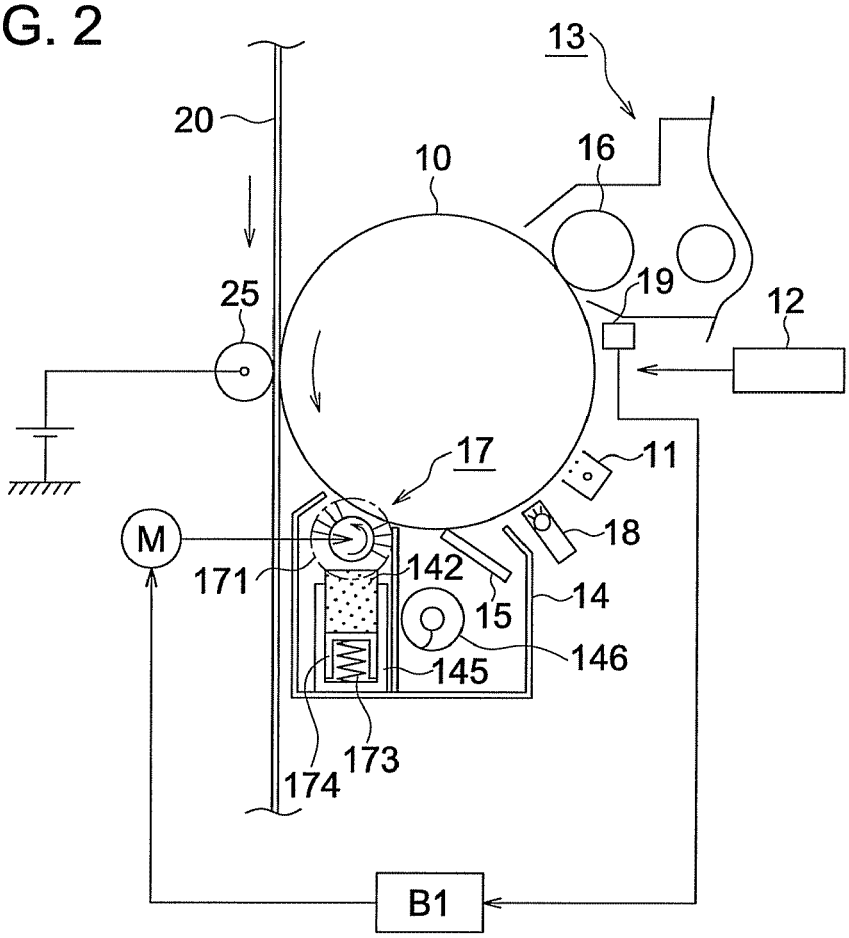
FIG. 2 is an enlarged drawing of the circumference of a photoconductor of any one of colors Y, M, C and K.

An embodiment of the present invention will now be detailed while referring to FIG. 2.

FIG. 2 is an enlarged drawing of a photoconductor of any one of Y, M, C and K, and integrated components.

In FIGS. 1 and 2, to coat the lubricant onto the surface of photoconductor 10, roller brush (hereinafter referred to as "brush") 171 picks up lubricant 142 at a position that is separated from a position where roller brush 171 touches photoconductor 10. After brush 171 picks up lubricant 142, brush 171 is rotated and applies said lubricant 171 onto photoconductor 10.

In cleaning devices 14 of photoconductors 10 of Y, M, C and K, blade 15 scrapes any remaining toner particles from the surface of photoconductor 10, said toner particles are then stored within cleaning devices 14, from where toner conveyance screw 146 rotates to convey the toner particles in the axial direction of the screw, and the toner particles are conveyed to be stored in a disposal box, through a disposing tube which is not illustrated. Numeral 17 represents a lubricant coating mechanism, which includes brush 171 formed of nylon fibers or electrically conductive acrylic fibers, lubricant 142 formed of zinc stearate (which is ZnSt) exhibiting a pencil hardness of HB, supporting guide 145 for lubricant 142, pushing base 174 which slides in supporting guide 145, and pressure spring 173 which pushes lubricant 142 against brush 171 at a predetermined force through pushing base 174, which serves as a pushing mechanism. In the present embodiment, brush 171 rotates in the same direction as photoconductor 10, but they may also rotate in opposite directions. Brush 171 is rotated by variable speed motor M, to which control section B1 instructs the rotation rate (rotation speed) corresponding to the detected results of electrical potential detecting sensor 19.

Since lubricant 142 is pushed against brush 171 by pressure spring 173 at the predetermined force, lubricant 142 is applied onto the surface of photoconductor 10, whereby the frictional resistance between photoconductor 10 and blade 15 is reduced so that cleaning is conducted more effectively. Lubricant 142 is consumed little by little, but is pushed up by pressure spring 173, while the pressure between brush 171 and lubricant 142 is maintained within a predetermined force limit in this embodiment.

Lubricant 142 is applied to coat the surface of photoconductor 10 which carries the remaining toner particles, and both the remaining toner particles and the applied lubricant are scraped away by blade 15. However, a portion of lubricant 142 still remains on the surface of photoconductor 10, to wait next image formation.

Since the electrical resistance of lubricant 142 is relatively great, when lubricant 142 has been layered onto the photoconductor or onto the intermediate transfer body, it appears as if the electrical resistance of the photoconductor or the intermediate transfer body increases. Under this condition, the image formation is conducted so that the toner image is transferred from photoconductor 10 onto intermediate transfer belt 20, the electrical discharge occurs during the image transfer operation, which results in an abnormal image transfer, exhibiting such as black spots.

Further, as described above, if images of a relatively high text ratio are continuously printed, a large amount of toner particles are supplied onto the brush, whereby the amount of toner particles accumulated on the brush becomes greater than the amount of toner particles removed by a flicker. Due to this condition, the brush cannot remove the appropriate amount of the lubricant, so that the surface of the photoconductor is not coated with the appropriate amount of lubricant. Further, since the toner particles have been accumulated onto the brush, when the brush contacts the surface of the photoconductor, a portion on which the toner particles directly adhere appears on the photoconductor, and a portion which the brush directly contacts also appears on the photoconductor. If the brush directly contacts the photoconductor due to the frictional electrification, not through the lubricant, any one of the photoconductor or the brush is charged to be a negative electrode or a positive electrode, due to the frictional electrification, and vise versa, depending upon the component materials of the photoconductor and the brush. Still further, if the toner particles accumulated on the brush contact the photoconductor by the frictional electrification, the same phenomenon as above occurs. Due to the frictional electrification, the surface of the photoconductor is highly charged to be negative or positive.

In the present invention, the electrical potential of the surface of the photoconductor is detected by the electrical potential detecting section, and the coated condition on the surface is measured by the detected value of the electrical potential of the surface, so that the optimal coating condition for the lubricant is controlled.

For measuring the coating condition of the lubricant on the surface of the photoconductor, not only an image forming mode, but also a surface potential measuring mode is provided in which the electrical potential of the surface of the photoconductor is measured. During the surface potential measuring mode, scorotron charging device 11 and discharging lamp 18 are deactivated. Because if they are activated, they adversely affect the surface potential after coating. While photoconductor 10 rotates, brush 171 also rotates so that brush 171 picks ups lubricant 142, which is then applied onto the remaining toner particles on the surface of photoconductor 10. The remaining toner particles and the lubricant are then scraped away by blade 15, but a part of lubricant 142 still remains on the surface of photoconductor 10. Said remaining lubricant 142 is conveyed to electrical potential detecting sensor 19, whereby its surface potential is detected, which value is transmitted to control section B1. Control section B1 instructs variable speed motor M to rotate at the rotation rate corresponding to the detected value.

Control section B1 stores a table which shows the relationships between classifications to show the coating condition corresponding to the surface potential, and the rotation speed of motor M to supply the appropriate amount of lubricant onto the surface (which is an amount of lubricant picked up by the brush).

In this embodiment, the optimum rotation speed of the brush is measured for each classification by the experiments, which data is stored in control section B1 as shown in following Table 1.

TABLE 1

| classification | Electrical Potential (V) of the Surface of Photoconductor | Coated Condition of Lubricant | Brush speed (mm/s)/ Rotation Rate(RPM) |
|---|---|---|---|
| 1 | ~−200 | worst | 24/382 |
| 2 | −200~−100 | worse | 176.7/286.5 |
| 3 | −100~−20 | better | 120/191 |
| 4 | −20~0 | best | 60/95.5 |
| 5 | 0~+20 | better | 176.7/286.5 |
| 6 | +20~ | worse | 240/382 |

In Table 1, classifications 1, 2 and 6 show unacceptable coating conditions, accordingly the rotation rate of the brush is controlled to be greater so that the coating amount in these classifications is controlled to be greater, like the level of classifications 3-5. That is, if the electrical potential of the surface of the photoconductor is higher than the predetermined electrical potential, the coating amount should be controlled to be greater, while if the electrical potential is lower than that, the coating amount should be controlled to be lower.

Figure 3:
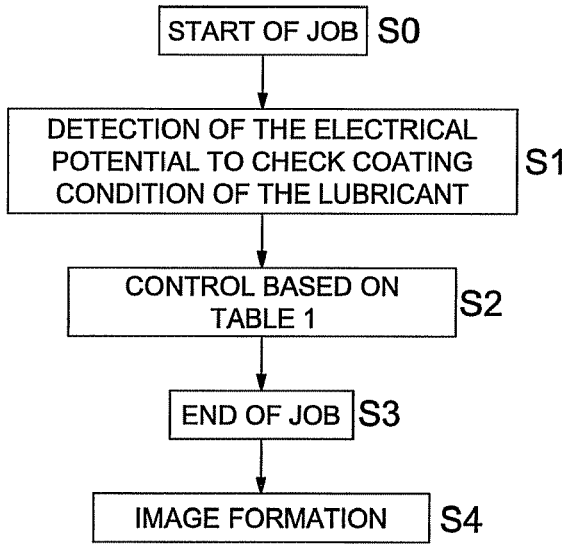
FIG. 3 is a flow chart to attain an appropriate coating condition corresponding to the electrical potential of the surface of the photoconductor.

FIG. 3 shows the flow chart to control the above description.

FIG. 3 is a flow chart to attain an appropriate lubricant coating conditions corresponding to the electrical potential of the surface of the photoconductor.

In FIG. 3, the electrical potential measuring mode is started (as a job) in step S0. Detection of the electrical potential of the surface of the photoconductor is conducted to check the coated condition at initiation of the image formation or before the start of printing in step S1 (being an electrical potential measuring mode). The rotation rate of the brush is controlled in step S2, based on a classification in Table 1 related to the detected electrical potential of the surface of the photoconductor. The amount of lubricant to be supplied onto the photoconductor by the selected rotation rate of the brush is determined in step S3, after which the coated condition of the lubricant is checked so that the electrical potential measuring mode is completed. Print formation is then conducted in step S4 at the determined rotation rate of the brush.

Said electrical potential measuring mode is used, when the image forming apparatus starts, when the printing operation is completed, or when the following printing operation starts. Further, the rotation rate of the brush is changed before a normal image starting sequence, after the electrical potential of the surface of the photoconductor has been detected.

Next, the detection of empty lubricant will be detailed.

As described above, the lubricant is picked up by the brush and is supplied to the photoconductor. When the lubricant is almost consumed, the coating amount tends to become less on the photoconductor, whereby the surface-electrical potential becomes abnormal value.

The present invention further relates to a control section which detects said abnormal value and shows a warning message to replenish the lubricant.

In FIG. 2, the amount of lubricant 142 reduces as the increased consumption, and the consumption amount can be calculated based on an accumulated revolution times (a number of times of the revolution) of brush 171. Accordingly, sufficient lubricant can be loaded based on revolution times N of brush 171.

When the lubricant is completely consumed, the warning message is shown to the operator so that the lubricant must be replenished.

In the present embodiment, when the accumulated revolution times of the brush approaches revolution times N, or when the electrical potential in any one of classifications 1, 2, and 6 is continuously detected plural times, a display section of scanning panel 85 (see FIG. 1) is controlled to display the warning message.

Figure 4:
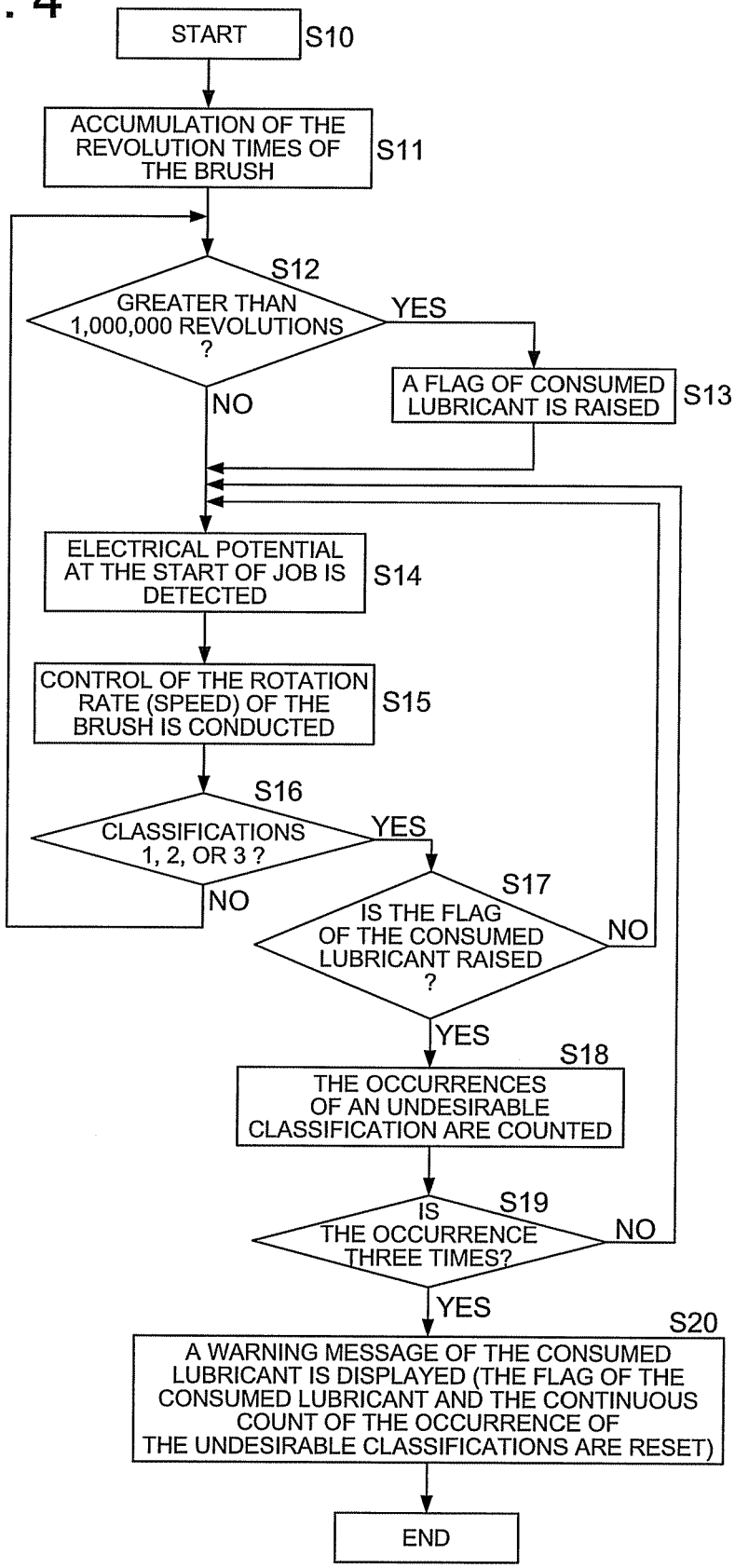
FIG. 4 is a flow chart of a process regarding the warning message to replenish the lubricant.

The warning message to replenish the lubricant will now be detailed, while referring to FIG. 4.

FIG. 4 is a flow chart of a process regarding the warning message to replenish the lubricant.

In FIG. 4, image formation is started in step S10, whereby brush 171 is controlled to rotate so that some lubricant is coated onto photoconductor 10. The revolution times of brush 171 is accumulated in step S11. In step S12, it is determined whether said accumulated revolution times is greater than revolution times N (which is set to be one million) of brush 171 which corresponds to a previously set consumption amount of lubricant. If the accumulated number is greater than revolution times N in step S12 (Yes in step S12), "a flag (which is a warning message) of consumed lubricant" is displayed on operation panel 85 in step S13, and the process flow advances to step S14. If the accumulated number is less than revolution times N in step S12 (No in step S12), the process flow advances to step S14. In step S14, the electrical potential of the surface of the photoconductor 10 at the start of the print job is measured, and the coated condition of the lubricant shown in Table 1 is detected, subsequently in step S15, the rotation rate of the brush is controlled based on the coated condition. In addition, in step S16, checked is whether the value of the electrical potential of the surface of the photoconductor, detected in step S14, falls into any one of classifications 1, 2 and 6 in Table 1. If it is "No" in step S16, brush 171 further rotates to supply the lubricant onto photoconductor 10. If it is "Yes" in step S16, checked in step S17 is whether "the flag (which is the warning message) of the consumed lubricant" has been displayed on operation panel 85. If it is "No" in step S17, the process flow reverses to step S14, which is detection of the electrical potential of the surface of the photoconductor. If it is "Yes" in step S17, the number of occurrences of the undesirable classifications (which are 1, 2 or 6) is continuously counted in step S18. In step S19, checked is whether said number of occurrences is three or not. If it is "No" in step S19, the process flow reverses to step S14, which is detection of the electrical potential of the surface. If it is "Yes" in step S19, warning messages "consumed lubricant" and "replenish lubricant" are displayed.

Based on these displays, the operator replenishes lubricant so that the preferable image formation can continue.

In the embodiment described above, the coated condition of the lubricant on the surface of the photoconductor can be measured by the electrical potential of the surface of the photoconductor. Accordingly, the measurement accuracy is greatly upgraded so that the surface of photoconductor is appropriately lubricated, and the optimal surface condition can be maintained with the appropriate amount of lubricant, whereby unacceptable image toner transfer due to faulty cleaning is prevented, and the preferable image formation can be conducted.

In addition, the present embodiment controls the optimal coating amount of lubricant onto the photoconductor, by changing the rotation speed (rotation rate) of the brush. However, it is also possible to control the coating amount of lubricant, by changing an amount of brush contact on the photoconductor, or by changing the force of the roller brush against the lubricant, under the constant rotation speed (rotation rate) of brush 171, both of which are conducted based on the detected electrical potential of the surface of the photoconductor, whereby the coating amount of lubricant onto the photoconductor can be controlled.

What is claimed is:

1. An image forming apparatus, comprising:

a photoconductor;

a charging section to apply an electrical potential onto a surface of the photoconductor;

a cleaning device to remove toner particles remaining on the surface of the photoconductor;

a coating section to coat the surface of the photoconductor with a lubricant;

an electrical potential detecting section to detect the electrical potential of the surface of the photoconductor; and a control section which controls a coating condition of the lubricant based on a value of the electrical potential of the surface of the photoconductor, detected by the electrical potential detecting section.

2. The image forming apparatus of claim 1, wherein when the electrical potential of the surface of the photoconductor is over a range of a predetermined electrical potential, the control section controls a coating amount of the lubricant to be greater than when the electrical potential of the surface of the photoconductor is included in the range of the predetermined electrical potential.

3. The image forming apparatus of claim 1, wherein when the electrical potential detecting section detects the electrical potential of the surface of the photoconductor, the control section deactivates the charging section.

4. The image forming apparatus of claim 1, further comprising an electrical charge discharging section which discharges the toner particles remaining on the surface of the photoconductor at an upstream position of the charging section, wherein when the electrical potential detecting section detects the electrical potential of the surface of the photoconductor, the control section deactivates the electrical charge discharging section.

5. The image forming apparatus of claim 1, wherein the coating section comprises a roller brush being rotatable.

6. The image forming apparatus of claim 5, wherein an amount of the lubricant to be coated by the coating section is controlled by a rotation speed of the roller brush.

7. The image forming apparatus of claim 5, wherein the coating section further comprises a pushing mechanism which pushes the lubricant against the roller brush at a position that is separated from a position where the roller brush touches the photoconductor, wherein the control section controls the amount of the lubricant to be coated by the coating section, by a pushing force generated by the pushing mechanism.

8. The image forming apparatus of claim 6, wherein the control section controls the amount of the lubricant to be coated by the coating section, by a contacting amount of the roller brush to the photoconductor.

* * * * *